US011756495B2

(12) United States Patent
Zhang

(10) Patent No.: US 11,756,495 B2
(45) Date of Patent: Sep. 12, 2023

(54) PIXEL STRUCTURE DRIVING METHOD AND DISPLAY DEVICE

(71) Applicant: TCL China Star Optoelectronics Technology Co., Ltd., Guangdong (CN)

(72) Inventor: Yonglei Zhang, Guangdong (CN)

(73) Assignee: TCL China Star Optoelectronics Technology Co., Ltd., Shenzhen (CN)

( * ) Notice: Subject to any disclaimer, the term of this patent is extended or adjusted under 35 U.S.C. 154(b) by 196 days.

(21) Appl. No.: 17/442,209

(22) PCT Filed: Dec. 23, 2020

(86) PCT No.: PCT/CN2020/138450
§ 371 (c)(1),
(2) Date: Sep. 23, 2021

(87) PCT Pub. No.: WO2022/077761
PCT Pub. Date: Apr. 21, 2022

(65) Prior Publication Data

US 2022/0310028 A1 Sep. 29, 2022

(30) Foreign Application Priority Data

Oct. 16, 2020 (CN) ..... 202011112985.9

(51) Int. Cl.
*G09G 3/36* (2006.01)

(52) U.S. Cl.
CPC ..... *G09G 3/3614* (2013.01); *G09G 3/3607* (2013.01); *G09G 3/3688* (2013.01);
(Continued)

(58) Field of Classification Search
CPC .. G09G 3/3614; G09G 3/3607; G09G 3/3688; G09G 3/2074; G09G 2300/0447; G09G 2300/0452; G09G 2360/16
See application file for complete search history.

(56) References Cited

U.S. PATENT DOCUMENTS

2008/0186271 A1 8/2008 Yokoyama et al.
2013/0321483 A1* 12/2013 You ..... G09G 3/2074 345/690

(Continued)

FOREIGN PATENT DOCUMENTS

CN 101615382 12/2009
CN 103472642 12/2013

(Continued)

*Primary Examiner* — David Tung

(57) ABSTRACT

A pixel structure driving method and a display device are provided. The driving method includes obtaining a polarity of each of the data lines of a current frame, determining a polarity of each of the sub-pixels according to the polarity of each of the data lines and an arrangement of the pixel structure, performing a value look-up process according to a polarity and an initial gray value of each of the sub-pixels to obtain a polarity high/low gray value of each of the sub-pixels, if a luminance of a high gray value of a positive polarity of a sub-pixel of a color is different from a luminance of a high gray value of a negative polarity of the sub-pixel of the color, adjusting the polarity high/low gray value of the sub-pixel. In this way, the occurrence of vertical strips in a still image could be alleviated.

20 Claims, 4 Drawing Sheets

(52) U.S. Cl.
CPC ..... *G09G 2300/0447* (2013.01); *G09G 2300/0452* (2013.01)

(56) References Cited

U.S. PATENT DOCUMENTS

| | | | | |
|---|---|---|---|---|
| 2014/0354707 | A1* | 12/2014 | Tsuei | G09G 3/3614 345/690 |
| 2016/0275890 | A1 | 9/2016 | Ra et al. | |
| 2016/0335966 | A1* | 11/2016 | Kumagai | G09G 3/3614 |
| 2018/0226045 | A1* | 8/2018 | Sohn | G02F 1/13306 |
| 2020/0175930 | A1* | 6/2020 | Koo | G09G 3/3406 |

FOREIGN PATENT DOCUMENTS

| | | |
|---|---|---|
| CN | 104183221 | 12/2014 |
| CN | 109215598 | 1/2019 |
| CN | 109272951 | 1/2019 |
| CN | 109872702 | 6/2019 |
| CN | 110767191 | 2/2020 |
| CN | 111028812 | 4/2020 |
| CN | 111128090 | 5/2020 |
| CN | 111261117 | 6/2020 |
| CN | 111474791 | 7/2020 |

* cited by examiner

PIXEL STRUCTURE DRIVING METHOD AND DISPLAY DEVICE

RELATED APPLICATIONS

This application is a National Phase of PCT Patent Application No. PCT/CN2020/138450 having International filing date of Dec. 23, 2020, which claims the benefit of priority of Chinese Patent Application No. 202011112985.9 filed on Oct. 16, 2020. The contents of the above applications are all incorporated by reference as if fully set forth herein in their entirety.

FIELD AND BACKGROUND OF THE INVENTION

The present disclosure relates to a display technology, and more particularly, to a pixel structure driving method and a display device.

As a higher demand for a better display quality of an LCD TV, a super wide view angle and high resolution of images have become a new development trend.

A high-definition LCD display requires more pixels integrated in a limited size of glass substrate. This becomes a big challenge for the front-end manufacturing process of the display device. In order to raise the display quality of the HD LCD TV, a pair of high/low gray values is often used to replace a pixel value. However, under this mechanism, the luminance of the high gray value of the positive polarity is different from the luminance of the low gray value of the negative polarity and thus vertical strips occur in a still image.

Therefore, there is a demand for a display device that could avoid the vertical strips in a still image.

SUMMARY OF THE INVENTION

One objective of an embodiment of the present disclosure is to provide a pixel structure driving method and a display device, which could avoid the vertical strips in a still image.

According to an embodiment of the present disclosure, a driving method for driving a pixel structure is disclosed. The pixel structure comprises a plurality of pixel units and data lines arranged in an array. The pixel unit comprises a plurality of sub-pixels. Each sub-pixel is placed between adjacent data lines. Sub-pixels corresponding to a same column have a same color. Sub-pixels of adjacent columns have opposite polarities and are divided as high-grey values and low-grey values. The driving method comprises: obtaining a polarity of each of the data lines of a current frame; determining a polarity of each of the sub-pixels according to the polarity of each of the data lines and an arrangement of the pixel structure; performing a value look-up process according to a polarity and an initial gray value of each of the sub-pixels to obtain a polarity high/low gray value of each of the sub-pixels; and if a luminance of a high gray value of a positive polarity of a sub-pixel of a color is different from a luminance of a high gray value of a negative polarity of the sub-pixel of the color or a luminance of a low gray value of the positive polarity of a sub-pixel of the color is different from a luminance of a low gray value of the negative polarity of the sub-pixel of the color, adjusting the polarity high/low gray value of the sub-pixel.

According to one embodiment of the present disclosure, the step of obtaining the polarity of each of the data lines of the current frame comprises:

obtaining a polarity of a leftmost data line of the current frame; and determining the polarity of each of the data lines in a horizontal direction according to the polarity of the leftmost data line.

According to one embodiment of the present disclosure, the step of performing the value look-up process according to the polarity and the initial gray value of each of the sub-pixels to obtain the polarity high/low gray value of each of the sub-pixels comprises:

if the polarity of the sub-pixel is a positive polarity, performing the value look-up process according to the positive polarity and the initial gray value of the sub-pixel to obtain a positive polarity high/low gray value; and if the polarity of the sub-pixel is a negative polarity, performing the value look-up process according to the negative polarity and the initial gray value of the sub-pixel to obtain a negative polarity high/low gray value.

According to one embodiment of the present disclosure, the step of performing the value look-up process according to the positive polarity and the initial gray value of the sub-pixel to obtain a positive polarity high/low gray value comprises:

performing a huge view angle algorithm on the initial gray value of the sub-pixel having the positive polarity to obtain the positive polarity high/low gray value.

According to one embodiment of the present disclosure, the step of performing the value look-up process according to the negative polarity and the initial gray value of the sub-pixel to obtain a positive polarity high/low gray value comprises:

performing a huge view angle algorithm on the initial gray value of the sub-pixel having the negative polarity to obtain the negative polarity high/low gray value.

According to one embodiment of the present disclosure, the step of adjusting the polarity high/low gray value of the sub-pixel if the luminance of the high gray value of the positive polarity of the sub-pixel of the color is different from the luminance of the high gray value of the negative polarity of the sub-pixel of the color or the luminance of the low gray value of the positive polarity of the sub-pixel of the color is different from the luminance of the low gray value of the negative polarity of the sub-pixel of the color comprises:

determining if the luminance of the high gray value of the positive polarity of the sub-pixel of the color is different from the luminance of the high gray value of the negative polarity of the sub-pixel of the color or the luminance of the low gray value of the positive polarity of the sub-pixel of the color is different from the luminance of the low gray value of the negative polarity of the sub-pixel of the color; and if the luminance of the high gray value of the positive polarity of the sub-pixel of the color is different from the luminance of the high gray value of the negative polarity of the sub-pixel of the color or the luminance of the low gray value of the positive polarity of the sub-pixel of the color is different from the luminance of the low gray value of the negative polarity of the sub-pixel of the color, adjusting the polarity high/low gray value of the sub-pixel such that the luminance of the high gray value of the positive polarity of the sub-pixel of the color is identical to the luminance of the high gray value of the negative polarity of the sub-pixel of the color or the luminance of the low gray value of the positive polarity of the sub-pixel of the color is identical to the luminance of the low gray value of the negative polarity of the sub-pixel of the color.

According to one embodiment of the present disclosure, the step of adjusting the polarity high/low gray value of the sub-pixel comprises:

if the luminance of the high gray value of the positive polarity of the sub-pixel of the color is higher than the luminance of the high gray value of the negative polarity of the sub-pixel of the color, increase a gray value of the high gray value of the negative polarity of the sub-pixel or decrease a gray value of the high gray value of the positive polarity of the sub-pixel such that the luminance of the high gray value of the positive polarity of the sub-pixel of the color is identical to the luminance of the high gray value of the negative polarity of the sub-pixel of the color.

According to one embodiment of the present disclosure, the step of adjusting the polarity high/low gray value of the sub-pixel comprises:

if the luminance of the low gray value of the positive polarity of the sub-pixel of the color is higher than the luminance of the low gray value of the negative polarity of the sub-pixel of the color, increasing a gray value of the low gray value of the negative polarity of the sub-pixel or decreasing a gray value of the low gray value of the positive polarity of the sub-pixel such that the luminance of the low gray value of the positive polarity of the sub-pixel of the color is identical to the luminance of the low gray value of the negative polarity of the sub-pixel of the color.

According to one embodiment of the present disclosure, the step of determining the polarity of each of the sub-pixels according to the polarity of each of the data lines and the arrangement of the pixel structure comprises:

determining the polarity of each of the sub-pixels according to the polarity of each of the data lines and arrangements of high gray value and low gray value in the pixel structure.

According to one embodiment of the present disclosure, each of the plurality of pixel units comprise a red sub-pixel, a green sub-pixel, and a blue sub-pixel.

According to an embodiment of the present disclosure, a display device is disclosed. The display device comprises a pixel structure, an obtaining unit, a determining unit, a processing unit and an adjusting unit. The pixel structure comprises a plurality of pixel units and data lines arranged in an array, wherein the pixel unit comprises a plurality of sub-pixels, each sub-pixel is placed between adjacent data lines, sub-pixels corresponding to a same column have a same color, and sub-pixels of adjacent columns have opposite polarities and are divided as high-grey values and low-grey values. The obtaining unit is configured to obtain a polarity of each of the data lines of a current frame. The determining unit is configured to determine a polarity of each of the sub-pixels according to the polarity of each of the data lines and an arrangement of the pixel structure. The processing unit is configured to perform a value look-up process according to a polarity and an initial gray value of each of the sub-pixels to obtain a polarity high/low gray value of each of the sub-pixels. The adjusting unit is configured to, adjust the polarity high/low gray value of the sub-pixel if a luminance of a high gray value of a positive polarity of a sub-pixel of a color is different from a luminance of a high gray value of a negative polarity of the sub-pixel of the color or a luminance of a low gray value of the positive polarity of a sub-pixel of the color is different from a luminance of a low gray value of the negative polarity of the sub-pixel of the color.

According to an embodiment of the present disclosure, the obtaining unit is configured to obtain a polarity of a leftmost data line of the current frame, and to determine the polarity of each of the data lines in a horizontal direction according to the polarity of the leftmost data line.

According to an embodiment of the present disclosure, the processing unit is configured to perform the value look-up process according to the positive polarity and the initial gray value of the sub-pixel to obtain a positive polarity high/low gray value if the polarity of the sub-pixel is a positive polarity, and to perform the value look-up process according to the negative polarity and the initial gray value of the sub-pixel to obtain a negative polarity high/low gray value if the polarity of the sub-pixel is a negative polarity.

According to an embodiment of the present disclosure, the processing unit is configured to perform a huge view angle algorithm on the initial gray value of the sub-pixel having the positive polarity to obtain the positive polarity high/low gray value.

According to an embodiment of the present disclosure, the processing unit is configured to: perform a huge view angle algorithm on the initial gray value of the sub-pixel having the negative polarity to obtain the negative polarity high/low gray value.

According to an embodiment of the present disclosure, the adjusting unit is configured to: determine if the luminance of the high gray value of the positive polarity of the sub-pixel of the color is different from the luminance of the high gray value of the negative polarity of the sub-pixel of the color or the luminance of the low gray value of the positive polarity of the sub-pixel of the color is different from the luminance of the low gray value of the negative polarity of the sub-pixel of the color; and to adjust the polarity high/low gray value of the sub-pixel such that the luminance of the high gray value of the positive polarity of the sub-pixel of the color is identical to the luminance of the high gray value of the negative polarity of the sub-pixel of the color or the luminance of the low gray value of the positive polarity of the sub-pixel of the color is identical to the luminance of the low gray value of the negative polarity of the sub-pixel of the color, if the luminance of the high gray value of the positive polarity of the sub-pixel of the color is different from the luminance of the high gray value of the negative polarity of the sub-pixel of the color or the luminance of the low gray value of the positive polarity of the sub-pixel of the color is different from the luminance of the low gray value of the negative polarity of the sub-pixel of the color.

According to an embodiment of the present disclosure, the adjusting unit is configured to increase a gray value of the high gray value of the negative polarity of the sub-pixel or decrease a gray value of the high gray value of the positive polarity of the sub-pixel such that the luminance of the high gray value of the positive polarity of the sub-pixel of the color is identical to the luminance of the high gray value of the negative polarity of the sub-pixel of the color, if the luminance of the high gray value of the positive polarity of the sub-pixel of the color is higher than the luminance of the high gray value of the negative polarity of the sub-pixel of the color.

According to an embodiment of the present disclosure, the adjusting unit is configured to increase a gray value of the low gray value of the negative polarity of the sub-pixel or decrease a gray value of the low gray value of the positive polarity of the sub-pixel such that the luminance of the low gray value of the positive polarity of the sub-pixel of the color is identical to the luminance of the low gray value of the negative polarity of the sub-pixel of the color, if the luminance of the low gray value of the positive polarity of the sub-pixel of the color is higher than the luminance of the low gray value of the negative polarity of the sub-pixel of the color.

According to an embodiment of the present disclosure, the determining unit is configured to determine the polarity of each of the sub-pixels according to the polarity of each of the data lines and arrangements of high gray value and low gray value in the pixel structure.

According to an embodiment of the present disclosure, each of the plurality of pixel units comprise a red sub-pixel, a green sub-pixel, and a blue sub-pixel.

The driving method for driving a pixel structure of the present disclosure are disclosed. The pixel structure includes a plurality of pixel units and data lines arranged in an array. The pixel unit comprises a plurality of sub-pixels. Each sub-pixel is placed between adjacent data lines, sub-pixels corresponding to a same column have a same color, sub-pixels of adjacent columns have opposite polarities and are divided as high-grey values and low-grey values. The driving method includes: obtaining a polarity of each of the data lines of a current frame; determining a polarity of each of the sub-pixels according to the polarity of each of the data lines and an arrangement of the pixel structure; performing a value look-up process according to a polarity and an initial gray value of each of the sub-pixels to obtain a polarity high/low gray value of each of the sub-pixels; and if a luminance of a high gray value of a positive polarity of a sub-pixel of a color is different from a luminance of a high gray value of a negative polarity of the sub-pixel of the color or a luminance of a low gray value of the positive polarity of a sub-pixel of the color is different from a luminance of a low gray value of the negative polarity of the sub-pixel of the color, adjusting the polarity high/low gray value of the sub-pixel. In the conventional art, when the common lines are not symmetric, the luminance of the high gray value of the positive polarity is different from the luminance of the low gray value of the negative polarity. Thus, the same row corresponding to two data lines may have different luminance so that vertical strips occur in a still image. In contrast to the conventional art, the pixel structure driving method and the display device in the present disclosure could adjust the high gray values of different polarities so that the luminance of the high gray value of the positive polarity becomes the same as the luminance of the low gray value of the negative polarity. In this way, the occurrence of vertical strips in a still image could be alleviated.

BRIEF DESCRIPTION OF SEVERAL VIEWS OF THE DRAWINGS

Embodiments of the present application are illustrated in detail in the accompanying drawings, in which like or similar reference numerals refer to like or similar elements or elements having the same or similar functions throughout the specification. The embodiments described below with reference to the accompanying drawings are exemplary and are intended to be illustrative of the present application, and are not to be construed as limiting the scope of the present application.

DESCRIPTION OF SPECIFIC EMBODIMENTS OF THE INVENTION

To help a person skilled in the art better understand the solutions of the present disclosure, the following clearly and completely describes the technical solutions in the embodiments of the present invention with reference to the accompanying drawings in the embodiments of the present invention. Apparently, the described embodiments are a part rather than all of the embodiments of the present invention. All other embodiments obtained by a person of ordinary skill in the art based on the embodiments of the present invention without creative efforts shall fall within the protection scope of the present disclosure.

The terminology used herein is for the purpose of describing particular embodiments only and is not intended to be limiting of the invention. As used herein, the singular forms "a", "said" and "the" are intended to include the plural forms as well, unless the context clearly indicates otherwise. It will be understood that the term "and/or," when used in this specification, specify one or more associated elements, alone or in combination, are provided. It will be further understood that the terms "first," "second," "third," and "fourth," when used in this specification, claim and drawings, are used to distinguish different objects, rather than to describe a specific order. It will be further understood that the terms "comprises" and/or "comprising," when used in this specification, specify the presence of stated features, products, steps, operations, elements, and/or components, but do not preclude the presence or addition of one or more other features, products, steps, operations, elements, components, and/or groups thereof.

Figure 1:
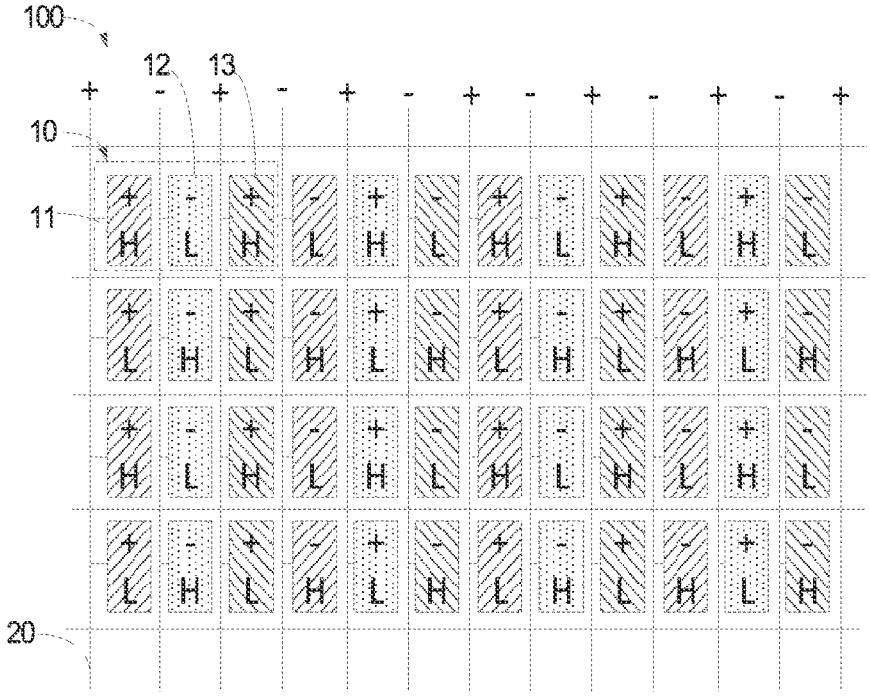
FIG. 1 is a diagram of a pixel structure according to an embodiment of the present disclosure.
Figure 2:
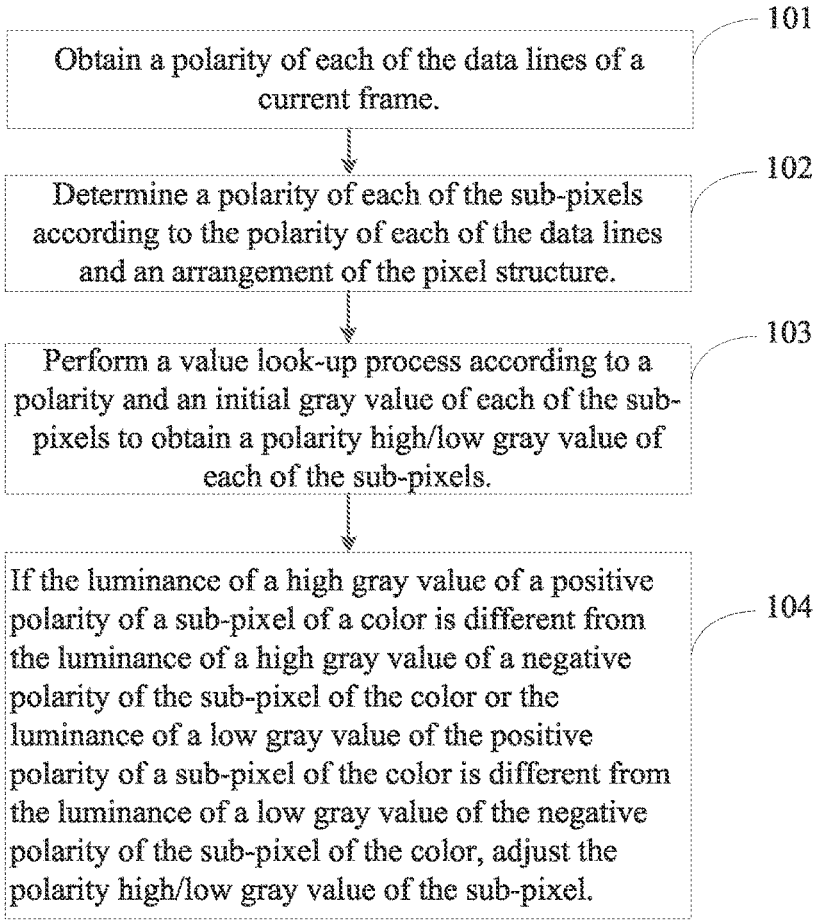
FIG. 2 is a diagram of a pixel structure driving method according to an embodiment of the present disclosure.

Please refer to FIG. 1 and FIG. 2. FIG. 1 is a diagram of a pixel structure according to an embodiment of the present disclosure. FIG. 2 is a diagram of a pixel structure driving method according to an embodiment of the present disclosure. The pixel structure 100 comprises a plurality of pixel units 10 and data lines 20 arranged in an array. The pixel unit 10 comprises sub-pixels. The sub-pixel is placed between adjacent data lines. The sub-pixels of the same column have the same color. The sub-pixels of adjacent columns have opposite polarities and are divided as high-grey values and low-grey values. The pixel unit 10 comprises a red sub-pixel 13, a green sub-pixel 11 and a blue sub-pixel 12. Specifically, the pixel units are arranged in an array. The blue sub-pixel 11, the green sub-pixel 12 and the red sub-pixel 13 are orderly arranged in a row in each of the pixel unit. The adjacent blue sub-pixels 11 have opposite polarities. The adjacent green sub-pixels 12 have opposite polarities. The adjacent red sub-pixels 13 have opposite polarities. As for two sub-pixels of adjacent rows, a high gray value is inputted to one sub-pixel and a low gray value is inputted to the other sub-pixel.

The pixel structure driving method comprises:

Step 101: Obtain a polarity of each of the data lines of a current frame.

Here, the polarity of each of the data lines of the current frame could be obtained through collecting information to determine the polarity of each of the data lines. This is not a limitation. The method could use other ways to obtain the polarity of each of the data lines of the current frame.

In some embodiments, the step of obtaining the polarity of each of the data lines of the current frame comprises:

(1) Obtain the polarity of the leftmost data line of the current frame.

Here, the driving method determines whether the leftmost data line in the horizontal direction of the current frame has a positive polarity or a negative polarity.

(2) Determine the polarity of each of the data lines in the horizontal direction according to the polarity of the leftmost data line.

Because the positive polarity and the negative polarity are alternatively arranged in the horizontal direction in the display device, when the polarity of the leftmost data line of the current frame is determined, the polarities of all the data lines could be determined according to the regularity of the polarity arrangement of the data lines in the horizontal direction. In this embodiment, the polarities of all the data lines are determined in this way to reduce the resources.

Step 102: Determine a polarity of each of the sub-pixels according to the polarity of each of the data lines and an arrangement of the pixel structure.

Because the polarity of each of the data lines is determined, the polarity of each of the sub-pixels could be determined according to the arrangement of sub-pixels and corresponding data lines.

In some embodiments, the step of determining the polarity of each of the sub-pixels according to the polarity of each of the data lines and the arrangement of the pixel structure comprises following step: Determine the polarity of each of the sub-pixels according to the polarity of each of the data lines and the arrangement of the high gray values and the low gray values.

Step 103: Perform a value look-up process according to a polarity and an initial gray value of each of the sub-pixels to obtain a polarity high/low gray value of each of the sub-pixels.

The method uses a sub-pixel as a unit to perform a bright/dark pre-process on the data lines to obtain the polarity high/low gray value of each of the sub-pixels. For example, after the value look-up process is performed on the sub-pixel having the positive polarity, the positive polarity high/low gray value could be obtained. After the value look-up process is performed on the sub-pixel having the negative polarity, the negative polarity high/low gray values could be obtained.

In some embodiments, the step of performing the value look-up process according to the polarity and the initial gray value of each of the sub-pixels to obtain the polarity high/low gray value of each of the sub-pixels comprises the following steps:

(1) If the polarity of the sub-pixel is positive, perform a value look-up process according to the positive polarity and the initial gray value of the sub-pixel to obtain the positive polarity high/low gray value.

Here, the method takes the sub-pixel having the positive polarity as a unit and performs a bright/dark preprocess on the data lines to obtain the positive polarity high/low gray value of each of the sub-pixels.

(2) If the polarity of the sub-pixel is negative, perform a value look-up process according to the negative polarity and the initial gray value of the sub-pixel to obtain the negative polarity high/low gray value.

Here, the method takes the sub-pixel having the negative polarity as a unit and performs a bright/dark preprocess on the data lines to obtain the negative polarity high/low gray value of each of the sub-pixels.

When the sub-pixel has a positive polarity, the method looks up the positive polarity gray value table. When the sub-pixel has a negative polarity, the method looks up the negative polarity gray value table. The positive polarity gray value table is different from the negative polarity gray value table.

The step of performing the value look-up process according to the positive polarity and the initial gray value of the sub-pixel to obtain the positive polarity high/low gray value comprises the following steps:

(1) Perform a huge view angle algorithm on the initial gray value of the sub-pixel having the positive polarity to obtain the positive polarity high/low gray value.

The huge view angle algorithm is to perform a pre-process on the data lines without changing the original display brightness. For example, taking a sub-pixel of the gray value 128 having the positive polarity as an example, the high/low gray values of a pair of positive-polarity sub-pixels are identified from the front-view gamma value, where the luminance of the average of the high/low gray values is equal to the luminance of the two positive-polarity sub-pixels of the gray value 128.

(2) Perform a huge view angle algorithm on the initial gray value of the sub-pixel having the negative polarity to obtain the negative polarity high/low gray value.

The huge view angle algorithm is to perform a pre-process on the data lines without changing the original display brightness. For example, taking a sub-pixel of the gray value 128 having the negative polarity as an example, the high/low gray values of a pair of negative-polarity sub-pixels are identified from the front-view gamma value, where the luminance of the average of the high/low gray values is equal to the luminance of the two negative-polarity sub-pixels of the gray value 128.

Step 104: If the luminance of a high gray value of a positive polarity of a sub-pixel of a color is different from the luminance of a high gray value of a negative polarity of the sub-pixel of the color or the luminance of a low gray value of the positive polarity of a sub-pixel of the color is different from the luminance of a low gray value of the negative polarity of the sub-pixel of the color, adjust the polarity high/low gray value of the sub-pixel.

When the common electrode lines are not completely symmetric, the luminance of a high gray value of a positive polarity may be different from the luminance of the high gray value of a negative polarity. In this way, two data lines may have different luminance at the same row and introduce the vertical strips. In this disclosure, high gray values of different polarities are adjusted such that the luminance of the high gray value of a positive polarity becomes the same as the luminance of the high gray value of a negative polarity. This could alleviate the generations of the vertical strips.

The step of adjusting the polarity high/low gray value of the sub-pixel if the luminance of a high gray value of a positive polarity of a sub-pixel of a color is different from the luminance of a high gray value of a negative polarity of the sub-pixel of the color or the luminance of a low gray value of the positive polarity of a sub-pixel of the color is different from the luminance of a low gray value of the negative polarity of the sub-pixel of the color.

(1) Determine if the luminance of the high gray value of the positive polarity of the sub-pixel of the color is different from the luminance of the high gray value of the negative polarity of the sub-pixel of the color or the luminance of the low gray value of the positive polarity of the sub-pixel of the color is different from the luminance of the low gray value of the negative polarity of the sub-pixel of the color.

Here, a logic board could be used to determine whether if the luminance of the high gray value of the positive polarity of the sub-pixel of the color is different from the luminance of the high gray value of the negative polarity of the sub-pixel of the color or the luminance of the low gray value of the positive polarity of the sub-pixel of the color is different from the luminance of the low gray value of the negative polarity of the sub-pixel of the color.

(2) If the luminance of the high gray value of the positive polarity of the sub-pixel of the color is different from the luminance of the high gray value of the negative polarity of the sub-pixel of the color or the luminance of the low gray value of the positive polarity of the sub-pixel of the color is different from the luminance of the low gray value of the negative polarity of the sub-pixel of the color, adjust the polarity high/low gray value of the sub-pixel such that the luminance of the high gray value of the positive polarity of the sub-pixel of the color is identical to the luminance of the high gray value of the negative polarity of the sub-pixel of the color or the luminance of the low gray value of the positive polarity of the sub-pixel of the color is identical to the luminance of the low gray value of the negative polarity of the sub-pixel of the color.

Here, if the luminance of the high gray value of the positive polarity of the sub-pixel of the color is different from the luminance of the high gray value of the negative polarity of the sub-pixel of the color or the luminance of the low gray value of the positive polarity of the sub-pixel of the color is different from the luminance of the low gray value of the negative polarity of the sub-pixel of the color, the polarity high/low gray value of the sub-pixel is adjusted such that the luminance of the high gray value of the positive polarity of the sub-pixel of the color is identical to the luminance of the high gray value of the negative polarity of the sub-pixel of the color or the luminance of the low gray value of the positive polarity of the sub-pixel of the color is identical to the luminance of the low gray value of the negative polarity of the sub-pixel of the color. However, it the luminance of the high gray value of the positive polarity of the sub-pixel of the color is the same as the luminance of the high gray value of the negative polarity of the sub-pixel of the color and the luminance of the low gray value of the positive polarity of the sub-pixel of the color is the same as the luminance of the low gray value of the negative polarity of the sub-pixel of the color, then there is no need to do any adjustment.

The step of adjusting the polarity high/low gray value of the sub-pixel comprises the following steps:

If the luminance of the high gray value of the positive polarity of the sub-pixel of the color is higher than the luminance of the high gray value of the negative polarity of the sub-pixel of the color, the method increases a gray value of the high gray value of the negative polarity of the sub-pixel or decreases a gray value of the high gray value of the positive polarity of the sub-pixel such that the luminance of the high gray value of the positive polarity of the sub-pixel of the color is identical to the luminance of the high gray value of the negative polarity of the sub-pixel of the color.

Through the above step, the luminance of the high gray value of the negative polarity of the sub-pixel of the color becomes the same as the luminance of the low gray value of the negative polarity of the sub-pixel of the color. This could alleviate the generation of vertical stripes.

If the luminance of the low gray value of the positive polarity of the sub-pixel of the color is higher than the luminance of the low gray value of the negative polarity of the sub-pixel of the color, the method increases a gray value of the low gray value of the negative polarity of the sub-pixel or decreases a gray value of the low gray value of the positive polarity of the sub-pixel such that the luminance of the low gray value of the positive polarity of the sub-pixel of the color is identical to the luminance of the low gray value of the negative polarity of the sub-pixel of the color.

As shown in FIG. 1, + represents a positive polarity and − represents a negative polarity. H represents a high gray value and L represents a low gray value.

Figure 3:
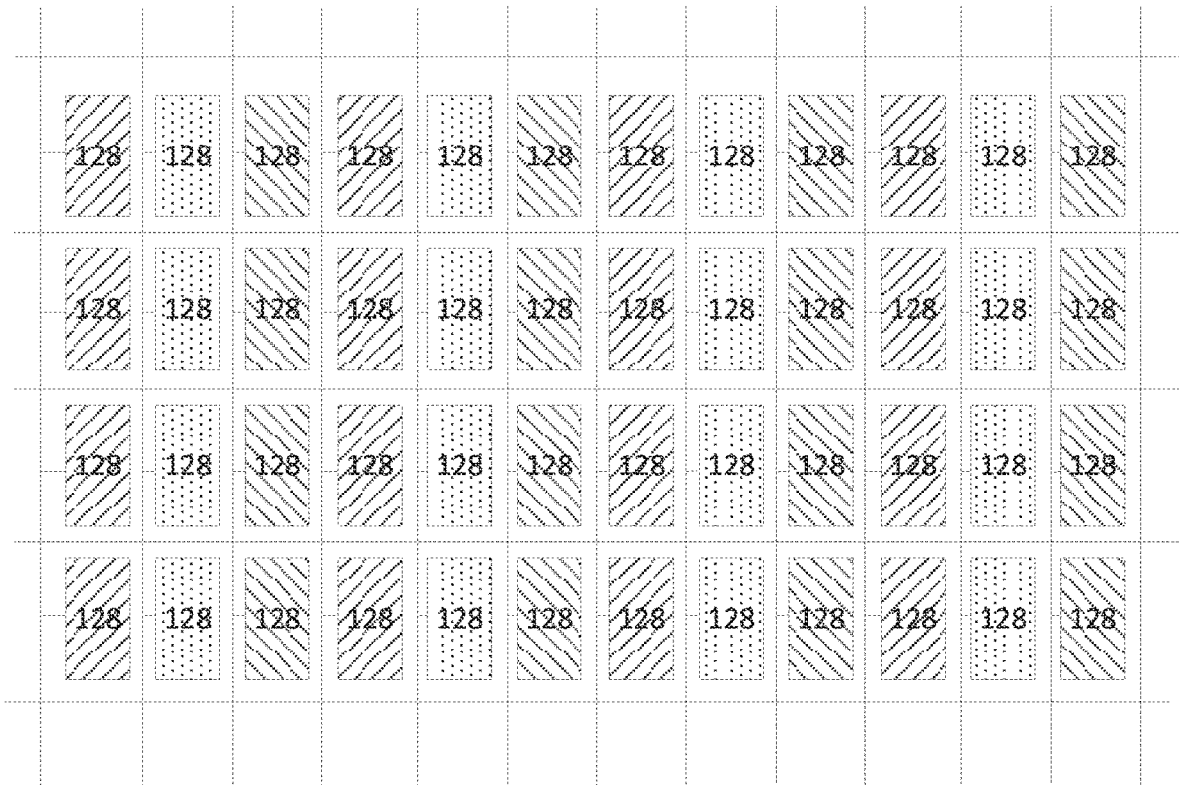
FIG. 3 is a diagram of conventional a pixel structure.
Figure 4:
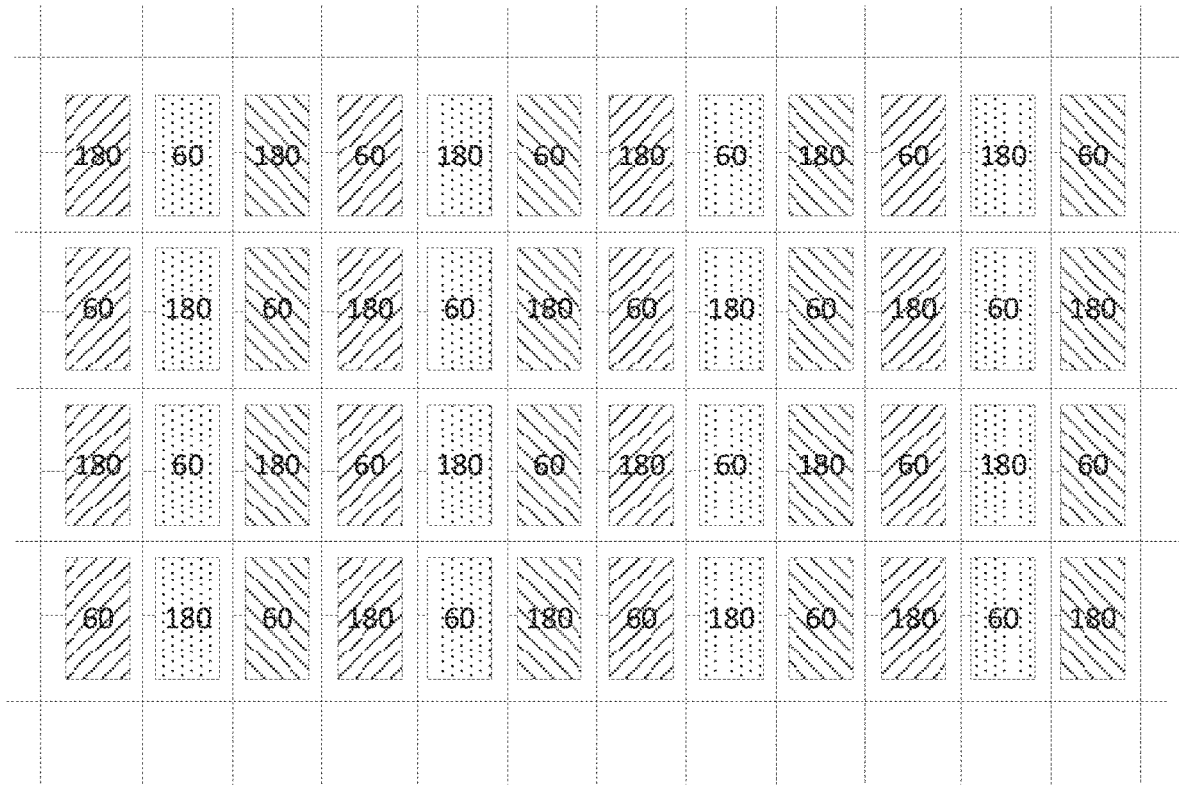
FIG. 4 is a diagram of a pixel structure after a value look-up process according to an embodiment of the present disclosure.
Figure 5:
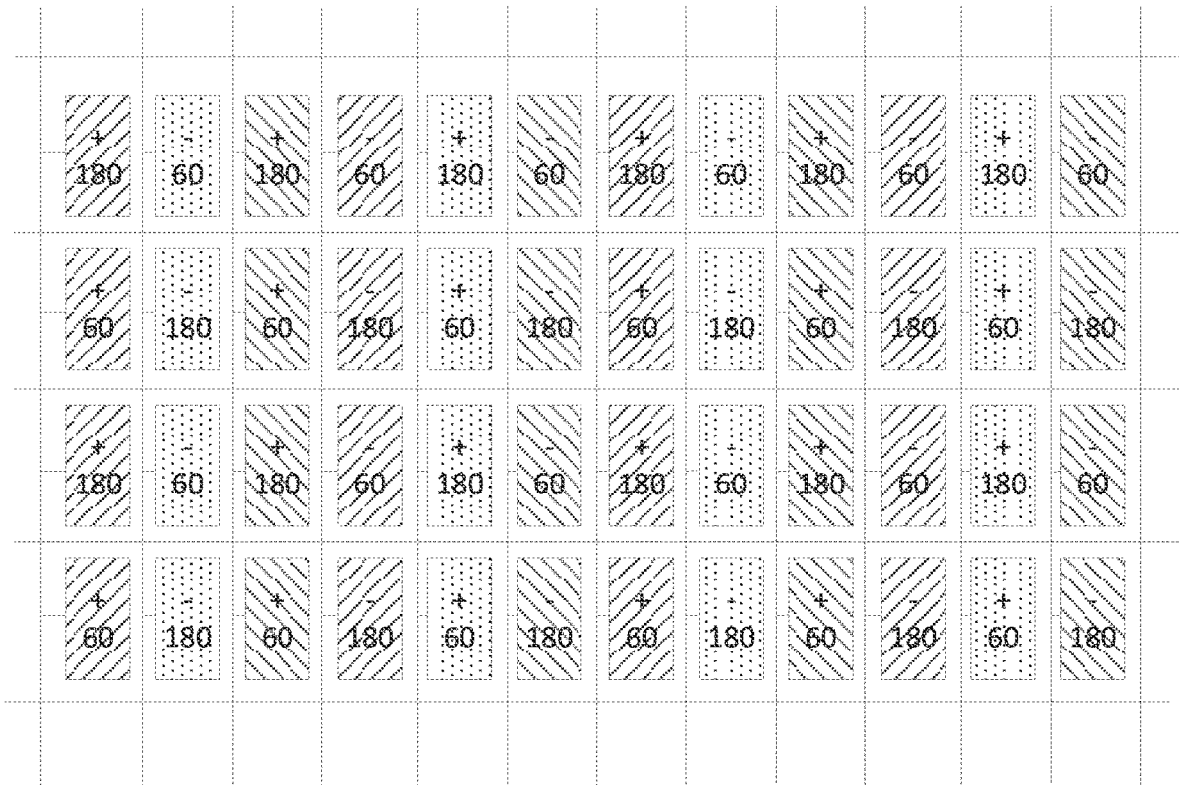
FIG. 5 is a diagram showing polarities of a pixel structure after a value look-up process according to an embodiment of the present disclosure.
Figure 6:
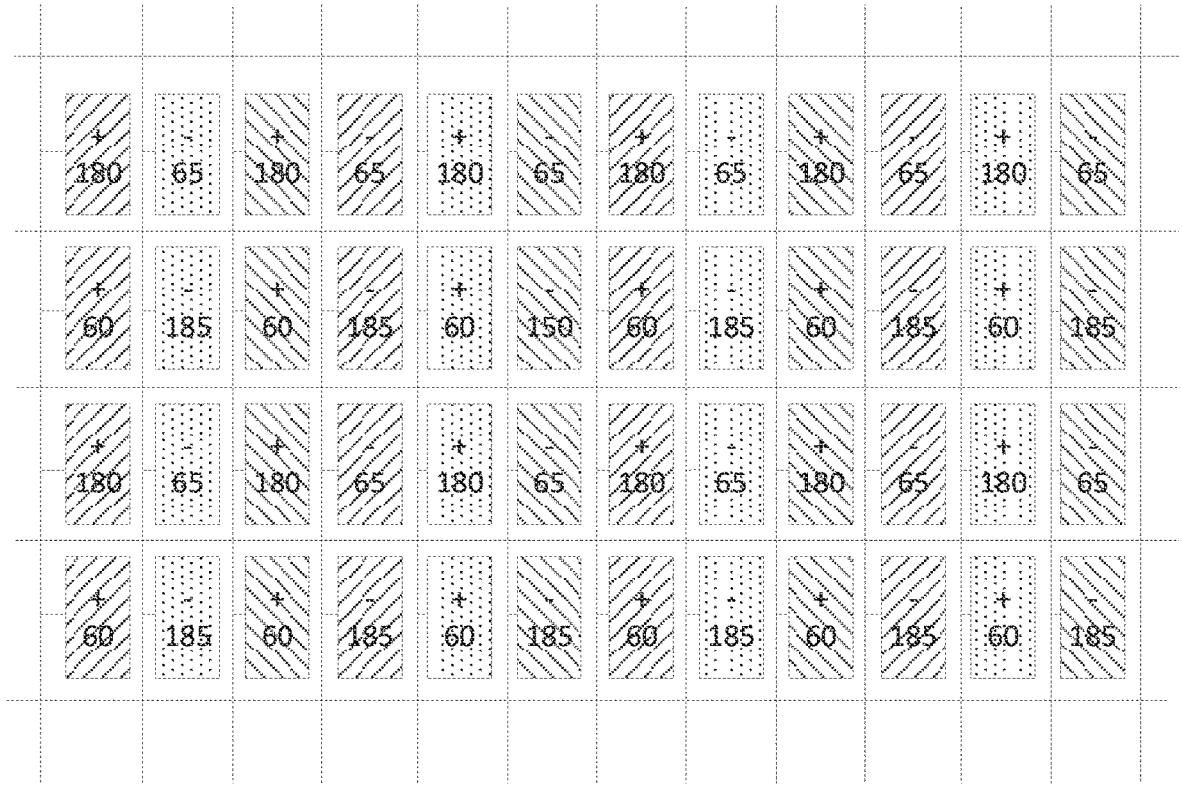
FIG. 6 is a diagram a pixel structure after a high/low gray value adjustment according to an embodiment of the present disclosure.

Taking that the original gray value of the sub-pixel is 128 as an example. The conventional sub-pixel arrangement is shown in FIG. 3. The gray value of each of the sub-pixels is 128. This conventional arrangement makes the view angle of the display panel smaller. As shown in FIG. 4, in order to raise the view angle of the display panel, the value look-up process could be performed based on each of the sub-pixels to get a high gray value and a low gray value. Specifically, a high gray value 180 and a low gray value 60 could be obtained through a value look-up process based on a sub-pixel having an original gray value 128. This method could raise the view angle of the display panel. Furthermore, the conventional pixel structure driving method often assigns the display voltage to different polarities and switches the polarities between the frames. This could protect the characteristics of the liquid crystals. Therefore, the pixel structure arrangement could be referred to the arrangement shown in FIG. 5. In this way, each of the sub-pixel could have its polarity. However, if the common electrode lines are not completely symmetric, the luminance of the high gray value of the positive polarity may be different from the luminance of the high gray value of the negative polarity or the luminance of the low gray value of the positive polarity may be different from the luminance of the low gray value of the negative polarity. This makes two data lines of the same row correspond to different luminance and generates vertical strips. According to an embodiment, the pixel structure driving method could avoid the vertical strips. For example, a fixed gray value of the sub-pixel could be obtained through the value look-up process. Taking a sub-pixel having an original gray value 128 as an example. Through the value look up process, a high gray value 180 and a low gray value 60 are obtained. Based on the polarity order, the high gray value 180 of a positive polarity and the low gray value of a negative polarity are obtained. Since the sub-pixels are arranged in an array. The high gray value of the positive polarity of a sub-pixel of a color is the same as the low gray value of the negative polarity of the sub-pixel of the color. At this time, if the common electrode lines are not completely symmetric, the luminance of the luminance of the high gray value of the positive polarity may be different from the luminance of the high gray value of the negative polarity. Thus, this makes two data lines of the same row correspond to different luminance and a still image may contain vertical strips. In the present disclosure, the driving method adjusts the high gray value of the positive polarity, the high gray value of the negative polarity, the low gray value of the positive polarity, and the low gray value of the negative polarity. As shown in FIG. 6, the low gray value −60 of the negative polarity is adjusted to be −65 and the high gray value −180 of the negative polarity is adjusted to be −185. In this way, the luminance of the high gray value of the positive polarity of a sub-pixel of a color is adjusted to be the same as the luminance of the high gray value of the negative polarity of the sub-pixel of the color and the luminance of the low gray value of the positive polarity of the sub-pixel of a color is adjusted to be the same as the luminance of the low gray value of the negative polarity of the sub-pixel of the color. Thus, it could alleviate the generation of vertical strips in a still image.

In order to better implement the pixel stricture driving method, a display device is disclosed according to an embodiment of the present disclosure. In this embodiment, the term having the same name has similar function of those disclosed in the above embodiments and thus further details are omitted here.

Figure 7:
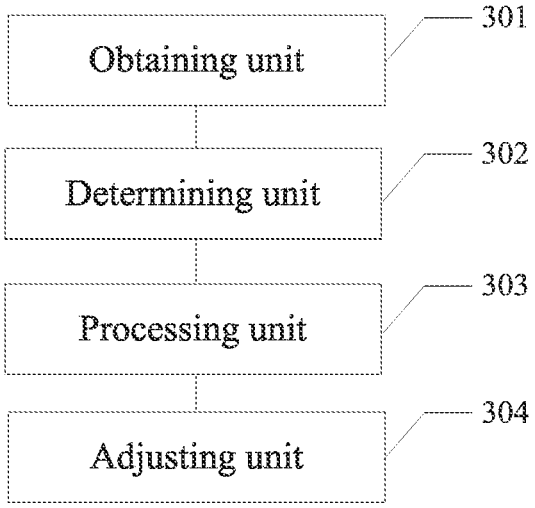
FIG. 7 is a diagram of a display device according to an embodiment of the present disclosure.

Please refer to FIG. 7. FIG. 7 is a diagram of a display device according to an embodiment of the present disclosure. The display device could comprise a pixel structure, an obtaining unit 301, a determining unit 302, a processing unit 303 and an adjusting unit 304. The pixel structure comprises a plurality of pixel units and data lines arranged in an array. The pixel unit comprises a plurality of sub-pixels. Each sub-pixel is placed between adjacent data lines. Sub-pixels corresponding to a same column have a same color. Sub-pixels of adjacent columns have opposite polarities and are divided as high-grey values and low-grey values.

The obtaining unit 301 is configured to obtain a polarity of each of the data lines of a current frame. The determining unit 302 is configured to determine a polarity of each of the sub-pixels according to the polarity of each of the data lines and an arrangement of the pixel structure. The processing unit 303 is configured to perform a value look-up process according to a polarity and an initial gray value of each of the sub-pixels to obtain a polarity high/low gray value of each of the sub-pixels. The adjusting unit 304 is configured to adjust the polarity high/low gray value of the sub-pixel if a luminance of a high gray value of a positive polarity of a sub-pixel of a color is different from a luminance of a high gray value of a negative polarity of the sub-pixel of the color or a luminance of a low gray value of the positive polarity of a sub-pixel of the color is different from a luminance of a low gray value of the negative polarity of the sub-pixel of the color.

Optionally, the obtaining unit 301 is configured to obtain a polarity of a leftmost data line of the current frame, and determine the polarity of each of the data lines in a horizontal direction according to the polarity of the leftmost data line.

Optionally, the processing unit 303 is configured to perform the value look-up process according to the positive polarity and the initial gray value of the sub-pixel to obtain a positive polarity high/low gray value if the polarity of the sub-pixel is a positive polarity. The processing unit 303 is also configured to perform the value look-up process according to the negative polarity and the initial gray value of the sub-pixel to obtain a negative polarity high/low gray value if the polarity of the sub-pixel is a negative polarity.

Optionally, the processing unit 303 is further configured to perform a huge view angle algorithm on the initial gray value of the sub-pixel having the positive polarity to obtain the positive polarity high/low gray value.

Optionally, the processing unit 303 is further configured to perform a huge view angle algorithm on the initial gray value of the sub-pixel having the negative polarity to obtain the negative polarity high/low gray value.

Optionally, the adjusting unit 304 is configured to determine if the luminance of the high gray value of the positive polarity of the sub-pixel of the color is different from the luminance of the high gray value of the negative polarity of the sub-pixel of the color or the luminance of the low gray value of the positive polarity of the sub-pixel of the color is different from the luminance of the low gray value of the negative polarity of the sub-pixel of the color. The adjusting unit 304 is also configured to adjust the polarity high/low gray value of the sub-pixel such that the luminance of the high gray value of the positive polarity of the sub-pixel of the color is identical to the luminance of the high gray value of the negative polarity of the sub-pixel of the color or the luminance of the low gray value of the positive polarity of the sub-pixel of the color is identical to the luminance of the low gray value of the negative polarity of the sub-pixel of the color, if the luminance of the high gray value of the positive polarity of the sub-pixel of the color is different from the luminance of the high gray value of the negative polarity of the sub-pixel of the color or the luminance of the low gray value of the positive polarity of the sub-pixel of the color is different from the luminance of the low gray value of the negative polarity of the sub-pixel of the color.

Optionally, the adjusting unit 304 is further configured to increase a gray value of the high gray value of the negative polarity of the sub-pixel or decrease a gray value of the high gray value of the positive polarity of the sub-pixel such that the luminance of the high gray value of the positive polarity of the sub-pixel of the color is identical to the luminance of the high gray value of the negative polarity of the sub-pixel of the color, if the luminance of the high gray value of the positive polarity of the sub-pixel of the color is higher than the luminance of the high gray value of the negative polarity of the sub-pixel of the color.

Optionally, the adjusting unit 304 is also configured to increase a gray value of the low gray value of the negative polarity of the sub-pixel or decrease a gray value of the low gray value of the positive polarity of the sub-pixel such that the luminance of the low gray value of the positive polarity of the sub-pixel of the color is identical to the luminance of the low gray value of the negative polarity of the sub-pixel of the color, if the luminance of the low gray value of the positive polarity of the sub-pixel of the color is higher than the luminance of the low gray value of the negative polarity of the sub-pixel of the color.

Optionally, the determining unit 302 is configured to determine the polarity of each of the sub-pixels according to the polarity of each of the data lines and arrangements of high gray value and low gray value in the pixel structure.

The display device of the present disclosure includes a pixel structure, an obtaining unit 301, a determining unit 302, a processing unit 303 and an adjusting unit 304. The pixel structure comprises a plurality of pixel units and data lines arranged in an array. The pixel unit comprises a plurality of sub-pixels. Each sub-pixel is placed between adjacent data lines. Sub-pixels corresponding to a same column have a same color. Sub-pixels of adjacent columns have opposite polarities and are divided as high-grey values and low-grey values. The obtaining unit 301 is configured to obtain a polarity of each of the data lines of a current frame. The determining unit 302 is configured to determine a polarity of each of the sub-pixels according to the polarity of each of the data lines and an arrangement of the pixel structure. The processing unit 303 is configured to perform a value look-up process according to a polarity and an initial gray value of each of the sub-pixels to obtain a polarity high/low gray value of each of the sub-pixels. The adjusting unit 304 is configured to adjust the polarity high/low gray value of the sub-pixel if a luminance of a high gray value of a positive polarity of a sub-pixel of a color is different from a luminance of a high gray value of a negative polarity of the sub-pixel of the color or a luminance of a low gray value of the positive polarity of a sub-pixel of the color is different from a luminance of a low gray value of the negative polarity of the sub-pixel of the color. In the conventional art, when the common lines are not symmetric, the luminance of the high gray value of the positive polarity is different from the luminance of the low gray value of the negative polarity. Thus, the same row corresponding to two data lines may have different luminance so that vertical strips occur in a still image. In contrast to the conventional art, the pixel structure driving method and the display device in the present disclosure could adjust the high gray values of different polarities so that the luminance of the high gray value of the positive polarity becomes the same as the luminance of the low gray value of the negative polarity. In this way, the occurrence of vertical strips in a still image could be alleviated.

Figure 8:
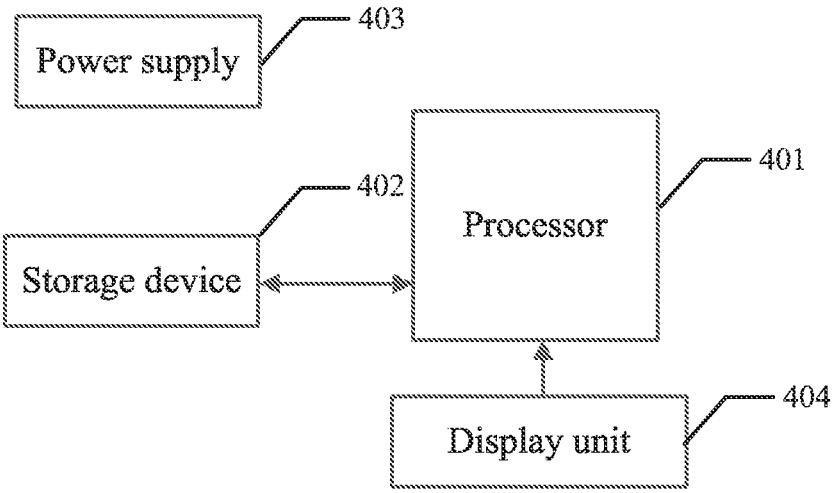
FIG. 8 is a diagram of a display panel according to an embodiment of the present disclosure.

Please refer to FIG. 8. FIG. 8 is a diagram of a display panel according to an embodiment of the present disclosure. The display panel could comprise a processor 401, a storage device 402, a power supply 403 and an input unit 404. The display panel shown in FIG. 8 is not a limitation of the present disclosure. In the actual implementation, the display panel could have more or less components or have a combination or arrangement of these components. These changes all fall within the scope of the present disclosure.

The processor 401 is a control center of the display panel, and connects various parts of the terminal by using various interfaces and lines. By running or executing the software program and/or module stored in the storage device 402, and invoking data stored in the storage device 402, the processor 401 performs various functions and data processing of the display panel, thereby performing overall monitoring on the mobile phone. Optionally, the processor 401 may include one or more processing cores. Preferably, the processor 401 may integrate an application processor and a modem. The application processor mainly processes an operating system, a user interface, an application program, and the like. The modem mainly processes wireless communication. It may be understood that, the foregoing modem may not be integrated into the processor 401.

The storage device 402 may be configured to store a software program and module. The processor 401 runs the software program and module stored in the storage device 402, to implement various functional applications and data processing. The storage device 402 may mainly include a program storage area and a data storage area. The program storage area may store an operating system, an application program required by at least one function (such as a sound playback function and an image display function), and the like. The data storage area may store data (such as audio data and an address book) created according to use of the display panel, and the like. In addition, the storage device 402 may include a high speed random access memory, and may also include a non-volatile memory, such as at least one magnetic disk storage device, a flash memory device, or another volatile solid-state storage device. Correspondingly, the storage device 402 may further include a memory controller, so that the processor 401 and the input unit 404 access the storage device 402.

The display panel further includes the power supply 403 for supplying power to the components. Preferably, the power supply may be logically connected to the processor 401 by using a power supply management system, thereby implementing functions, such as charging, discharging, and power consumption management, by using the power supply management system. The power supply 403 may further include any component, such as one or more direct current or alternate current power supplies, a re-charging system, a power supply fault detection circuit, a power supply converter or an inverter, and a power supply state indicator.

The input unit 404 may be configured to receive input digit or character information, and generate keyboard, mouse, joystick, optical, or track ball signal input related to the user setting and function control.

Although is not shown, the display panel could further comprise a graphic processing unit (GPU). The processor 401 of the display panel could load the executable documents corresponding to one or more application programs into the storage device and executes the application programs stored in the storage device to perform all functions, including the above-mentioned driving methods.

A person having ordinary skills in the art could understand that all or part of the steps in the above-mentioned driving method could be completed by executing instructions or executing instructions to control related hardware. The instructions could be stored in a computer readable storage medium and loaded and executed by the processor to perform operations comprising:

obtaining a polarity of each of the data lines of a current frame, determining a polarity of each of the sub-pixels according to the polarity of each of the data lines and an arrangement of the pixel structure, performing a value look-up process according to a polarity and an initial gray value of each of the sub-pixels to obtain a polarity high/low gray value of each of the sub-pixels, and if a luminance of a high gray value of a positive polarity of a sub-pixel of a color is different from a luminance of a high gray value of a negative polarity of the sub-pixel of the color or a luminance of a low gray value of the positive polarity of a sub-pixel of the color is different from a luminance of a low gray value of the negative polarity of the sub-pixel of the color, adjusting the polarity high/low gray value of the sub-pixel.

For the specific implementation of each of the above operations, refer to the previous embodiment, which will not be repeated here.

The storage medium may include: Read Only Memory (ROM, Read Only Memory), Random Access Memory (RAM, Random Access Memory), magnetic disk or optical disk, etc.

Since the instructions stored in the storage medium can execute the steps of the driving method provided in the embodiment of the present disclosure, it can achieve beneficial effects as disclosed in the previous embodiment for details, which will not be repeated here.

In the above-mentioned embodiments, the description of each embodiment has its own focus. For a part that is not described in detail in an embodiment, please refer to the detailed description of the information communication method above, which will not be repeated here.

According to an embodiment of the present disclosure, a storage medium is disclosed. The storage medium stores a plurality of instructions, which could be loaded and executed by a processor to perform all or part of the steps of the above-mentioned driving method.

Above are embodiments of the present disclosure, which does not limit the scope of the present disclosure. Any modifications, equivalent replacements or improvements within the spirit and principles of the embodiment described above should be covered by the protected scope of the disclosure.

What is claimed is:

1. A driving method for driving a pixel structure, the pixel structure comprising a plurality of pixel units and data lines arranged in an array, the pixel unit comprises a plurality of sub-pixels, wherein each sub-pixel is placed between adjacent data lines, sub-pixels corresponding to a same column have a same color, sub-pixels of adjacent columns have opposite polarities and are divided as high-grey values and low-grey values, the driving method comprising:

obtaining a polarity of each of the data lines of a current frame;

determining a polarity of each of the sub-pixels according to the polarity of each of the data lines and an arrangement of the pixel structure;

performing a value look-up process according to a polarity and an initial gray value of each of the sub-pixels to obtain a polarity high/low gray value of each of the sub-pixels; and when a luminance of a high gray value of a positive polarity of a sub-pixel of a color is different from a luminance of a high gray value of a negative polarity of the sub-pixel of the color or a luminance of a low gray value of the positive polarity of a sub-pixel of the color is different from a luminance of a low gray value of the negative polarity of the sub-pixel of the color, adjusting the polarity high/low gray value of the sub-pixel.

2. The driving method of claim 1, wherein the step of obtaining the polarity of each of the data lines of the current frame comprises:

obtaining a polarity of a leftmost data line of the current frame; and determining the polarity of each of the data lines in a horizontal direction according to the polarity of the leftmost data line.

3. The driving method of claim 1, wherein the step of performing the value look-up process according to the polarity and the initial gray value of each of the sub-pixels to obtain the polarity high/low gray value of each of the sub-pixels comprises:

when the polarity of the sub-pixel is a positive polarity, performing the value look-up process according to the positive polarity and the initial gray value of the sub-pixel to obtain a positive polarity high/low gray value; and when the polarity of the sub-pixel is a negative polarity, performing the value look-up process according to the negative polarity and the initial gray value of the sub-pixel to obtain a negative polarity high/low gray value.

4. The driving method of claim 3, wherein the step of performing the value look-up process according to the positive polarity and the initial gray value of the sub-pixel to obtain a positive polarity high/low gray value comprises:

performing a huge view angle algorithm on the initial gray value of the sub-pixel having the positive polarity to obtain the positive polarity high/low gray value.

5. The driving method of claim 3, wherein the step of performing the value look-up process according to the negative polarity and the initial gray value of the sub-pixel to obtain a positive polarity high/low gray value comprises:

performing a huge view angle algorithm on the initial gray value of the sub-pixel having the negative polarity to obtain the negative polarity high/low gray value.

6. The driving method of claim 1, wherein the step of adjusting the polarity high/low gray value of the sub-pixel when the luminance of the high gray value of the positive polarity of the sub-pixel of the color is different from the luminance of the high gray value of the negative polarity of the sub-pixel of the color or the luminance of the low gray value of the positive polarity of the sub-pixel of the color is different from the luminance of the low gray value of the negative polarity of the sub-pixel of the color comprises:

determining when the luminance of the high gray value of the positive polarity of the sub-pixel of the color is different from the luminance of the high gray value of the negative polarity of the sub-pixel of the color or the luminance of the low gray value of the positive polarity of the sub-pixel of the color is different from the luminance of the low gray value of the negative polarity of the sub-pixel of the color; and when the luminance of the high gray value of the positive polarity of the sub-pixel of the color is different from the luminance of the high gray value of the negative polarity of the sub-pixel of the color or the luminance of the low gray value of the positive polarity of the sub-pixel of the color is different from the luminance of the low gray value of the negative polarity of the sub-pixel of the color, adjusting the polarity high/low gray value of the sub-pixel such that the luminance of the high gray value of the positive polarity of the sub-pixel of the color is identical to the luminance of the high gray value of the negative polarity of the sub-pixel of the color or the luminance of the low gray value of the positive polarity of the sub-pixel of the color is identical to the luminance of the low gray value of the negative polarity of the sub-pixel of the color.

7. The driving method of claim 6, wherein the step of adjusting the polarity high/low gray value of the sub-pixel comprises:

when the luminance of the high gray value of the positive polarity of the sub-pixel of the color is higher than the luminance of the high gray value of the negative polarity of the sub-pixel of the color, increase a gray value of the high gray value of the negative polarity of the sub-pixel or decrease a gray value of the high gray value of the positive polarity of the sub-pixel such that the luminance of the high gray value of the positive polarity of the sub-pixel of the color is identical to the luminance of the high gray value of the negative polarity of the sub-pixel of the color.

8. The driving method of claim 6, wherein the step of adjusting the polarity high/low gray value of the sub-pixel comprises:

when the luminance of the low gray value of the positive polarity of the sub-pixel of the color is higher than the luminance of the low gray value of the negative polarity of the sub-pixel of the color, increasing a gray value of the low gray value of the negative polarity of the sub-pixel or decreasing a gray value of the low gray value of the positive polarity of the sub-pixel such that the luminance of the low gray value of the positive polarity of the sub-pixel of the color is identical to the luminance of the low gray value of the negative polarity of the sub-pixel of the color.

9. The driving method of claim 1, wherein the step of determining the polarity of each of the sub-pixels according to the polarity of each of the data lines and the arrangement of the pixel structure comprises:

determining the polarity of each of the sub-pixels according to the polarity of each of the data lines and arrangements of high gray value and low gray value in the pixel structure.

10. The driving method of claim 1, wherein each of the plurality of pixel units comprise a red sub-pixel, a green sub-pixel, and a blue sub-pixel.

11. A display device, comprising:

a pixel structure, comprising a plurality of pixel units and data lines arranged in an array, wherein the pixel unit comprises a plurality of sub-pixels, each sub-pixel is placed between adjacent data lines, sub-pixels corresponding to a same column have a same color, and sub-pixels of adjacent columns have opposite polarities and are divided as high-grey values and low-grey values;

a processor; and a storage device, storing software program;

wherein the software program is executed by the processor to:

obtain a polarity of each of the data lines of a current frame;

determine a polarity of each of the sub-pixels according to the polarity of each of the data lines and an arrangement of the pixel structure;

perform a value look-up process according to a polarity and an initial gray value of each of the sub-pixels to obtain a polarity high/low gray value of each of the sub-pixels; and adjust the polarity high/low gray value of the sub-pixel when a luminance of a high gray value of a positive polarity of a sub-pixel of a color is different from a luminance of a high gray value of a negative polarity of the sub-pixel of the color or a luminance of a low gray value of the positive polarity of a sub-pixel of the color is different from a luminance of a low gray value of the negative polarity of the sub-pixel of the color.

12. The display device of claim 11, wherein the software program is executed by the processor to:

obtain a polarity of a leftmost data line of the current frame; and determine the polarity of each of the data lines in a horizontal direction according to the polarity of the leftmost data line.

13. The display device of claim 11, wherein the software program is executed by the processor to:

perform the value look-up process according to the positive polarity and the initial gray value of the sub-pixel to obtain a positive polarity high/low gray value when the polarity of the sub-pixel is a positive polarity; and perform the value look-up process according to the negative polarity and the initial gray value of the sub-pixel to obtain a negative polarity high/low gray value when the polarity of the sub-pixel is a negative polarity.

14. The display device of claim 13, wherein the software program is executed by the processor to perform a huge view angle algorithm on the initial gray value of the sub-pixel having the positive polarity to obtain the positive polarity high/low gray value.

15. The display device of claim 13, wherein the software program is executed by the processor to: perform a huge view angle algorithm on the initial gray value of the sub-pixel having the negative polarity to obtain the negative polarity high/low gray value.

16. The display device of claim 11, wherein the software program is executed by the processor to:

determine when the luminance of the high gray value of the positive polarity of the sub-pixel of the color is different from the luminance of the high gray value of the negative polarity of the sub-pixel of the color or the luminance of the low gray value of the positive polarity of the sub-pixel of the color is different from the luminance of the low gray value of the negative polarity of the sub-pixel of the color; and adjust the polarity high/low gray value of the sub-pixel such that the luminance of the high gray value of the positive polarity of the sub-pixel of the color is identical to the luminance of the high gray value of the negative polarity of the sub-pixel of the color or the luminance of the low gray value of the positive polarity of the sub-pixel of the color is identical to the luminance of the low gray value of the negative polarity of the sub-pixel of the color, when the luminance of the high gray value of the positive polarity of the sub-pixel of the color is different from the luminance of the high gray value of the negative polarity of the sub-pixel of the color or the luminance of the low gray value of the positive polarity of the sub-pixel of the color is different from the luminance of the low gray value of the negative polarity of the sub-pixel of the color.

17. The display device of claim 16, wherein the software program is executed by the processor to increase a gray value of the high gray value of the negative polarity of the sub-pixel or decrease a gray value of the high gray value of the positive polarity of the sub-pixel such that the luminance of the high gray value of the positive polarity of the sub-pixel of the color is identical to the luminance of the high gray value of the negative polarity of the sub-pixel of the color, when the luminance of the high gray value of the positive polarity of the sub-pixel of the color is higher than the luminance of the high gray value of the negative polarity of the sub-pixel of the color.

18. The display device of claim 16, wherein the software program is executed by the processor to increase a gray value of the low gray value of the negative polarity of the sub-pixel or decrease a gray value of the low gray value of the positive polarity of the sub-pixel such that the luminance of the low gray value of the positive polarity of the sub-pixel of the color is identical to the luminance of the low gray value of the negative polarity of the sub-pixel of the color, when the luminance of the low gray value of the positive polarity of the sub-pixel of the color is higher than the luminance of the low gray value of the negative polarity of the sub-pixel of the color.

19. The display device of claim 11, wherein the software program is executed by the processor to determine the polarity of each of the sub-pixels according to the polarity of each of the data lines and arrangements of high gray value and low gray value in the pixel structure.

20. The display device of claim 11, wherein each of the plurality of pixel units comprise a red sub-pixel, a green sub-pixel, and a blue sub-pixel.

* * * * *